US011432602B2

(12) United States Patent
Cavender

(10) Patent No.: US 11,432,602 B2
(45) Date of Patent: Sep. 6, 2022

(54) NIGHTTIME HAND SIGNAL SYSTEM AND METHODS OF USE THEREOF

(71) Applicant: David M. Cavender, Smyrna, GA (US)

(72) Inventor: David M. Cavender, Smyrna, GA (US)

( * ) Notice: Subject to any disclaimer, the term of this patent is extended or adjusted under 35 U.S.C. 154(b) by 799 days.

(21) Appl. No.: 16/399,764

(22) Filed: Apr. 30, 2019

(65) Prior Publication Data

US 2019/0380405 A1 Dec. 19, 2019

Related U.S. Application Data

(60) Provisional application No. 62/684,864, filed on Jun. 14, 2018.

(51) Int. Cl.

| | |
|---|---|
| ***A41D 19/015*** | (2006.01) |
| ***A41D 19/00*** | (2006.01) |
| ***G08B 5/00*** | (2006.01) |

(52) U.S. Cl.

CPC ..... *A41D 19/0157* (2013.01); *A41D 19/0024* (2013.01); *G08B 5/004* (2013.01); *A41D 2600/20* (2013.01)

(58) Field of Classification Search

CPC ..... A41D 19/0157; A41D 19/0024; A41D 2600/20

See application file for complete search history.

(56) References Cited

U.S. PATENT DOCUMENTS

| | | | | |
|---|---|---|---|---|
| 2,581,549 | A | 1/1952 | McGaugh | |
| 4,467,005 | A | 8/1984 | Pusch et al. | |
| 6,006,357 | A | 12/1999 | Mead | |
| 6,127,007 | A | 10/2000 | Cox et al. | |
| 6,427,250 | B1 | 8/2002 | Stull et al. | |
| 6,623,148 | B2 | 9/2003 | Yagi et al. | |
| 6,701,649 | B1 | 3/2004 | Brosi | |
| 8,179,604 | B1 * | 5/2012 | Prada Gomez | G06F 1/163 359/13 |
| 8,918,919 | B2 | 12/2014 | Scholz | |
| 9,013,100 | B2 | 4/2015 | Bushee | |
| 9,854,859 | B2 | 1/2018 | McEwen | |
| 2011/0004973 | A1 | 1/2011 | Fortuna | |
| 2011/0258752 | A1 | 10/2011 | Matheney et al. | |
| 2017/0206691 | A1 * | 7/2017 | Harrises | G06T 11/60 |
| 2019/0371028 | A1 * | 12/2019 | Harrises | G06T 11/60 |

* cited by examiner

*Primary Examiner* — Gloria M Hale

(74) *Attorney, Agent, or Firm* — Mathew L. Grell; Grell & Watson Patent Attorneys LLC

(57) ABSTRACT

A nighttime hand signal system, having primarily a glove or fingerless glove having a backside, one or more infrared (IR) reflective material patterns affixed to the backside of the glove, an infrared (IR) light source, a night vision optical viewer, and thus functions to have the glove used by forward personnel in a police or military unit to provide a variety of hand signal communications to rear personnel using night vision optical viewer, as well as identify friend verse enemy personnel.

18 Claims, 6 Drawing Sheets

NIGHTTIME HAND SIGNAL SYSTEM AND METHODS OF USE THEREOF

CROSS-REFERENCE To RELATED APPLICATIONS

To the full extent permitted by law, the present United States Non-provisional patent application hereby claims priority to and the full benefit of, U.S. Provisional Application No. 62/684,864, filed on Jun. 14, 2018, entitled "Infrared (IR) Visible Gloves and Methods of Use", which is incorporated by reference herein in its entirety.

FIELD OF THE DISCLOSURE

The present disclosure is directed to a nighttime hand signal system and methods of use thereof. More specifically, the present disclosure is directed to an apparel item and more specifically a glove or partial glove for use with night vision optics system.

BACKGROUND

Various approaches have been utilized where a visible light at nighttime bounces off a reflective material that has been adhered to apparel items, such as shoes, socks, shorts, pants, shirts, helmets and the like to indicate the position of the wearer, such as a person, animal or object relative to the visible light source or person moving with the visible light source, such as a vehicle. One disadvantage or drawback to this approach is that, anyone with a light source causes a reflection and such a situation may not be favorable for military or police interested in maintain the secrecy of their position.

Another previous approach includes attaching a light source to an apparel items, such as shoes, socks, shorts, pants, shirts, helmets and the like to indicate the position of the wearer, such as a person, animal or object relative to a third party viewer or person moving within a vehicle. One disadvantage or drawback to this approach is that, everyone may see the light source and such a situation may not be favorable for military or police interested in maintain the secrecy of their position.

Therefore, it is readily apparent that there is a need for a nighttime hand signal system that can be easily used by forward personnel in a police or military unit to provide a variety of hand signal communication to others as well as identify friend verse enemy personnel using a night vision optic system. The instant disclosure is designed to address at least certain aspects of the problems or needs discussed above by enabling nonverbal signal instructions to be communicated to other team personnel using a night vision optic system.

SUMMARY

Briefly described, in an example embodiment, the present disclosure may overcome the above-mentioned disadvantages and may meet the recognized need for a nighttime hand signal system, having primarily a glove or fingerless glove having a backside, one or more infrared (IR) reflective material patterns affixed to the backside of the glove, an infrared (IR) light source, a night vision optical viewer, and thus functions to have the glove used by forward personnel in a police or military unit to provide a variety of hand signal communications to rear personnel using night vision optical viewer, as well as identify friend verse enemy personnel.

The instant disclosure is designed to address at least certain aspects of the problems or needs discussed above by enabling nonverbal signal instructions to be communicated to other team personnel using a night vision optic system.

Accordingly, in one aspect, the present disclosure may include a glove or fingerless glove or strap to be affixed to the hand, wrist or forearm having a backside; one or more infrared (IR) reflective material patterns affixed thereto the backside.

Accordingly, in another aspect, the present disclosure may include a system for enhancing hand signal communication at night, the system having an infrared (IR) light source, a night vision optical viewer, a glove or fingerless glove or strap to be affixed to the hand or arm having a backside, one or more infrared (IR) reflective material patterns affixed thereto the backside whereby infrared (IR) light is reflected by the infrared (IR) reflective material patterns positioned on a forward personnel (user) hand, wrist, or arm back to a rear personnel utilizing the a night vision optical viewer to communicate tactical instruction to rear personnel without verbal or transmitted communications.

In an exemplary embodiment of the nighttime hand signal communication system, includes a glove having a backside and adapted to be worn on a user's hand to communicate the hand signal communication, the backside having one or more infrared reflective material patterns affixed to the backside of the glove, an infrared light source positioned behind the glove, and a night vision optical viewer to view the infrared light source reflected off the infrared reflective material patterns affixed to the backside of the glove.

In another exemplary embodiment of a method of nonverbal hand signal communication at night, the method includes providing a glove having a backside, a finger sections, a thumb section and adapted to be worn on a user's hand, the backside having one or more infrared reflective material patterns affixed to the backside of the glove, an infrared light source positioned behind the glove, a night vision optical viewer to view the infrared light source reflected off the infrared reflective material patterns affixed to the backside of the glove, outfitting at least one forward personnel with the signaling glove, and outfitting at least one rear personnel with night vision optical viewer.

A feature of the apparatus or system of enhancing hand signal communication at night and methods of use thereof is to provide communications during covert operations performed by military and police personnel.

A feature of the apparatus or system of enhancing hand signal communication at night and methods of use thereof is to provide improved nonverbal and non-transmitted communications between military and police personnel utilizing night vision optic systems.

A feature of the apparatus or system of enhancing hand signal communication at night and methods of use thereof is to provide only hand signal communications (nonverbal) when any noise or wireless transmission will compromise the mission.

A feature of the apparatus or system of enhancing hand signal communication at night and methods of use thereof is to provide a communication system to military and police personnel designed not to emit any light signature which could interfere with the operator's vision while in use or inform non-friendly or enemy forces of position.

A feature of the apparatus or system of enhancing hand signal communication at night and methods of use thereof is to provide communications system that when viewed without night vision optics and infrared lights, the gloves do not reflect any ambient light, however when used with night vision and infrared light, the gloves reflect vividly and allow hand signals and infrared reflective material (pattern) to be easily discernable by colleagues.

A feature of the apparatus or system of enhancing hand signal communication at night and methods of use thereof is its ability to enhance the visibility of the hands, which are used to communicate nonverbally during covert nighttime operations under night vision.

A feature of the apparatus or system of enhancing hand signal communication at night and methods of use thereof is its ability to make the identification of friendly forces quickly under night vision operations.

A feature of the apparatus or system of enhancing hand signal communication at night and methods of use thereof is its ability to communicate with hand signals to helicopter pilots and other machine operators during low light night vision operations.

A feature of the apparatus or system of enhancing hand signal communication at night and methods of use thereof is its ability to prevent fratricide, i.e. the killing of friendly forces by other friendly forces, is through utilization of the present disclosures ability to provide positive identification of friendly forces by other friendly forces (rear personnel identifies the forward person as friendly forces).

A feature of the apparatus or system of enhancing hand signal communication at night and methods of use thereof is its ability to provide the insignia of the friendly forces to infrared (IR) reflective material patterns affixed to the backside of the glove.

These and other features of the apparatus or system of enhancing hand signal communication at night and methods of use thereof will become more apparent to one skilled in the art from the prior Summary and following Brief Description of the Drawings, Detailed Description of exemplary embodiments thereof, and Claims when read in light of the accompanying Drawings or Figures.

BRIEF DESCRIPTION OF THE DRAWINGS

The present the apparatus or system of enhancing hand signal communication at night and methods of use thereof will be better understood by reading the Detailed Description of the Preferred and Selected Alternate Embodiments with reference to the accompanying drawing Figures, in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

In describing the exemplary embodiments of the present disclosure, as illustrated in FIGS. 1, 2, 3, 4, 5, and 6 specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Figure 1:
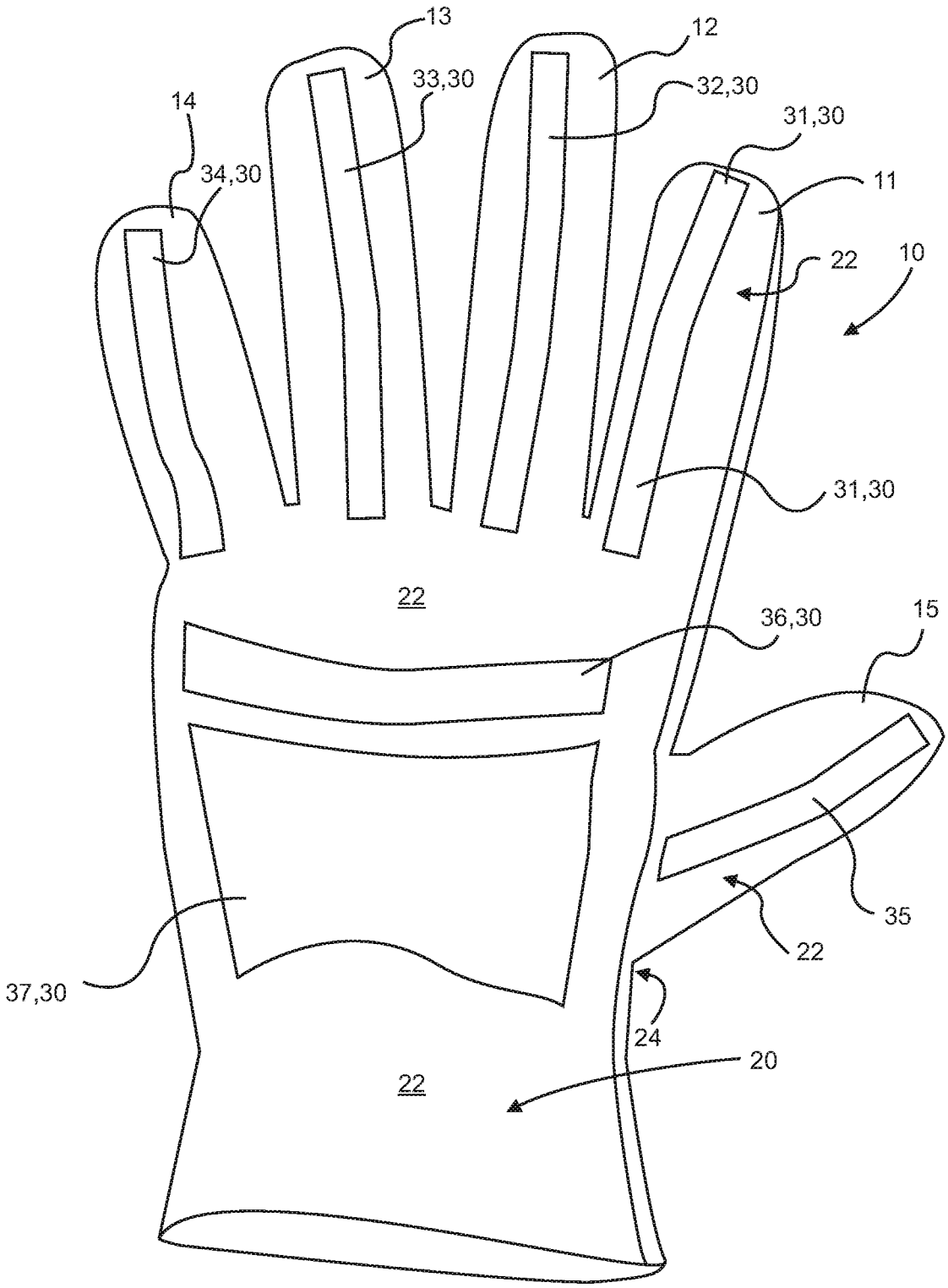
FIG. 1 is a perspective view of the apparatus for enhancing hand signal communication at night according to select embodiments of the instant disclosure.

Referring now to FIG. 1, by way of example, and not limitation, there is illustrated an example embodiment of an apparatus for enhancing hand signal communication at night, such as signaling glove 10. Preferably signaling glove 10 may include a glove section that covers the palm and back of hand, such as glove body 20 configured to fit over and be worn on user's hand like a conventional glove. Moreover, glove body 20 may include palm side 24 and back side 22, respectively configured to cover palm portion and back of the hand portion of user's hand when signaling glove 10 is worn. Furthermore, glove body 20 may include integral finger sections 11-14, including index finger section 11, middle finger section 12, ring finger section 13, and pinky finger section 14, and thumb section 15 extending therefrom glove body 20 to cover portions or all of user's fingers and thumb. It is contemplated herein that glove body 20, finger sections 11-14, and thumb section 15 may be configured as truncated where glove sections extend over a portion of glove body 20, finger sections 11-14, and thumb section 15, which enables signaling glove 10 to worn by a larger number of users with differing finger lengths. However, finger sections 11-14 and thumb section 15 are preferably configured to extend around entire finger and thumb and enclose user's hand to provide adequate surface area for clear signaling.

It is recognized herein that signaling glove 10 may be constructed of durable, flexible, or stretchable fabric or material, such as natural and synthetic fibers, leathers, rubber, canvas as these material offers a variety of forms, shapes, and a variety of user's hand sizes. Moreover, signaling glove 10 may include additional safety and protective properties including warmth, flame retardant, chemical retardant, water proof, cur proof to adapt signaling glove 10 for use in a variety of situations. It is contemplated that other suitable materials or the like, can be utilized, provided such material has sufficient strength, stretchability, and/or durability as would meet the purpose described herein.

Signaling glove 10 may further include one or more infrared (IR) reflective material 30 affixed to the back side 22. Moreover, infrared (IR) reflective material 30 may include a plurality of elongated pieces or strip(s) sections 31, 32, 33, 34, 35 (elongated strip section) affixed to or mounted thereon each of backside 22 of finger sections 11-14, and thumb section 15, respectively and positioned linear there-with finger sections 11-14, and thumb section 15 to provide maximum visibility of infrared (IR) reflective material 30 on each of finger sections 11-14, and thumb section 15. Furthermore, infrared (IR) reflective material 30 may include a plurality of sections, such as patterns 36, 37, affixed to or mounted thereon backside 22 of glove body 20 and positioned to identify friend verse enemy personnel using signaling glove 10 and to provide maximum visibility of infrared (IR) reflective material 30 on backside 22 of glove body 20. It is contemplated herein that patterns 36 and 37 may include a plurality of patterns or a variety shapes sizes and configurations of patterns to assist users in identifying friendly forces verse enemy personnel using signaling glove 10.

It is recognized herein that infrared (IR) reflective material 30 may be constructed of durable, flexible, or stretchable material to conform to user's hand and not restrict user's range of motion of fingers and thumb. Moreover, infrared (IR) reflective material 30 must be characterized by being substantially non-reflective to wave lengths in the visible light region of the electromagnetic spectrum but highly reflective to wave lengths in the infrared region of the electromagnetic spectrum. Furthermore, selective high reflectivity to wavelengths in the infrared region makes infrared (IR) reflective material 30 suitable for detection by persons observing through night vision goggles and non-reflective to visible light where it appears like black tape in both texture and finish. Still furthermore (IR) reflective material 30 may utilized to provide nonverbal and non-transmitted communications between users, such as military and police personnel utilizing night vision optic systems.

Figure 2:
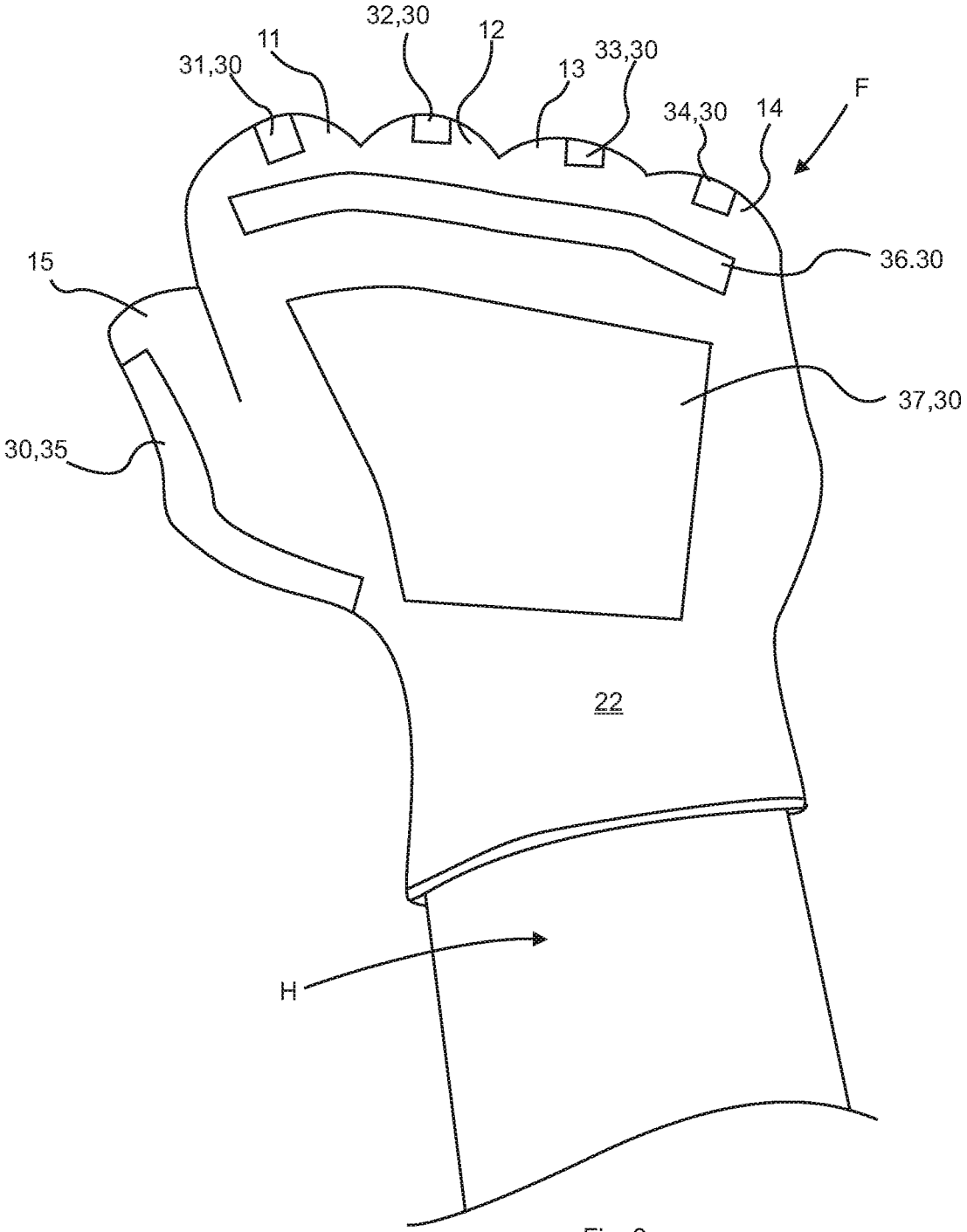
FIG. 2 is a perspective view of the apparatus for enhancing hand signal communication at night according to select embodiments of the instant disclosure, showing hand signal for stop all movement.

Referring now to FIG. 2, by way of example, and not limitation, there is illustrated an example embodiment of an apparatus for enhancing hand signal communication at night, such as signaling glove 10 showing hand signal for 'stop all movement'. Preferably signaling glove 10 via user's hand H has closed all finger sections 11-14, including index finger section 11, middle finger section 12, ring finger section 13, and pinky finger section 14, and thumb section 15 to form fist F with signaling glove 10. In this position signaling glove 10 presents or displays back side 22 of glove body 20 to other users in the rear or behind signaling glove 10 whereby other users may visualize patterns 36 and 37, affixed to or mounted thereon backside 22 of glove body 20 indicating fist F and nonverbal translation 'stop all movement'.

Figure 3:
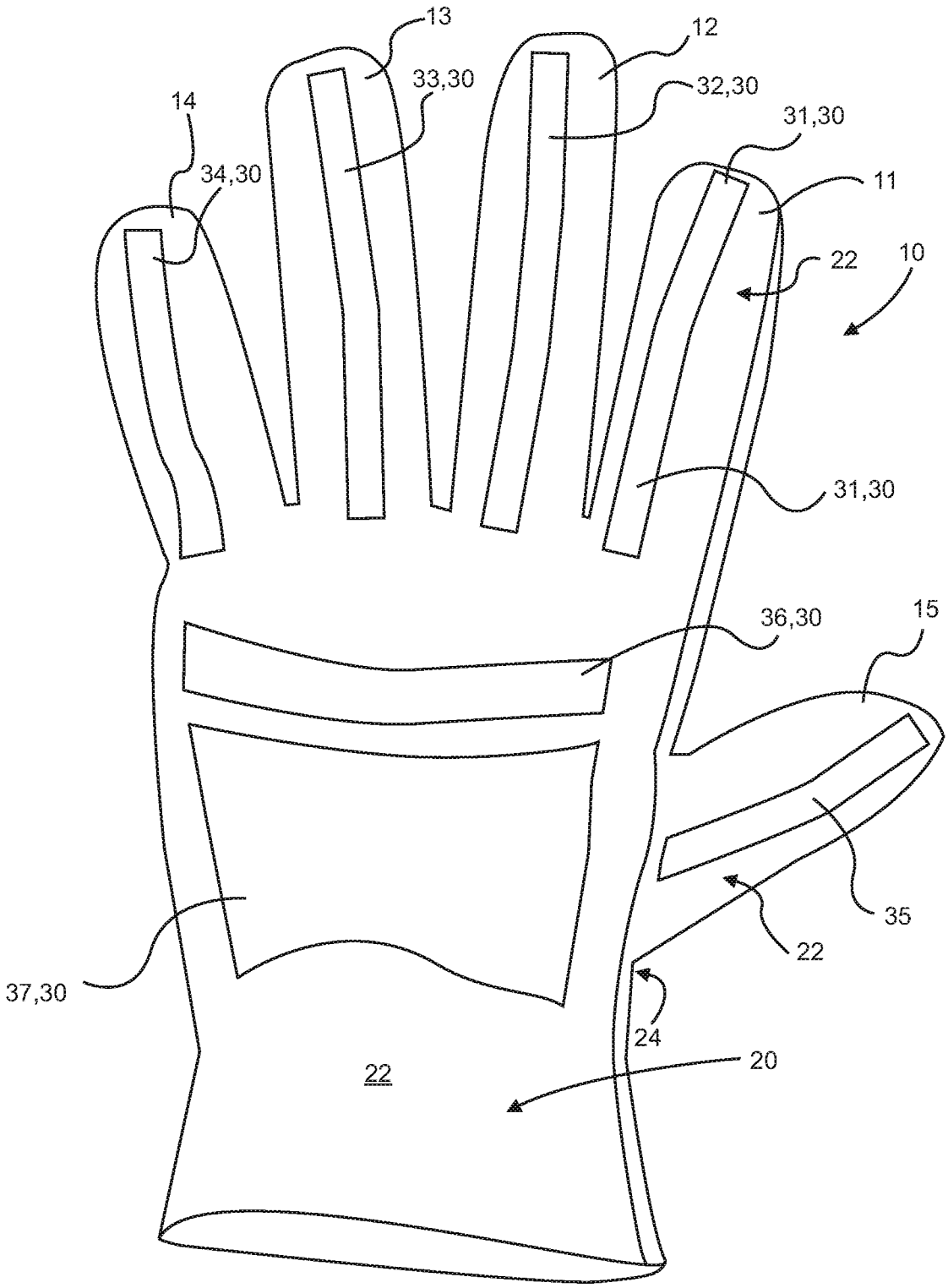
FIG. 3 is a perspective view of the apparatus for enhancing hand signal communication at night according to select embodiments of the instant disclosure, showing hand signal for five (5)

Referring now to FIG. 3, by way of example, and not limitation, there is illustrated an example embodiment of an apparatus for enhancing hand signal communication at night, such as signaling glove 10 showing hand signal for 'five (5)'. Preferably signaling glove 10 via user's hand has all fingers sections 11-14, including index finger section 11, middle finger section 12, ring finger section 13, and pinky finger section 14, and thumb section 15 are all spread apart to form signaling glove 10. In this position signaling glove 10 presents or displays back side 22 of glove body 20 to other users in the rear or behind signaling glove 10 whereby other users may visualize patterns of plurality of elongated pieces or strip sections 31, 32, 33, 34, 35 affixed to or mounted thereon each of backside 22 of finger sections 11-14, and thumb section 15 and patterns 36 and 37, affixed to or mounted thereon backside 22 of glove body 20 indicating 'five (5)' and nonverbal translation 'five count'.

Figure 4:
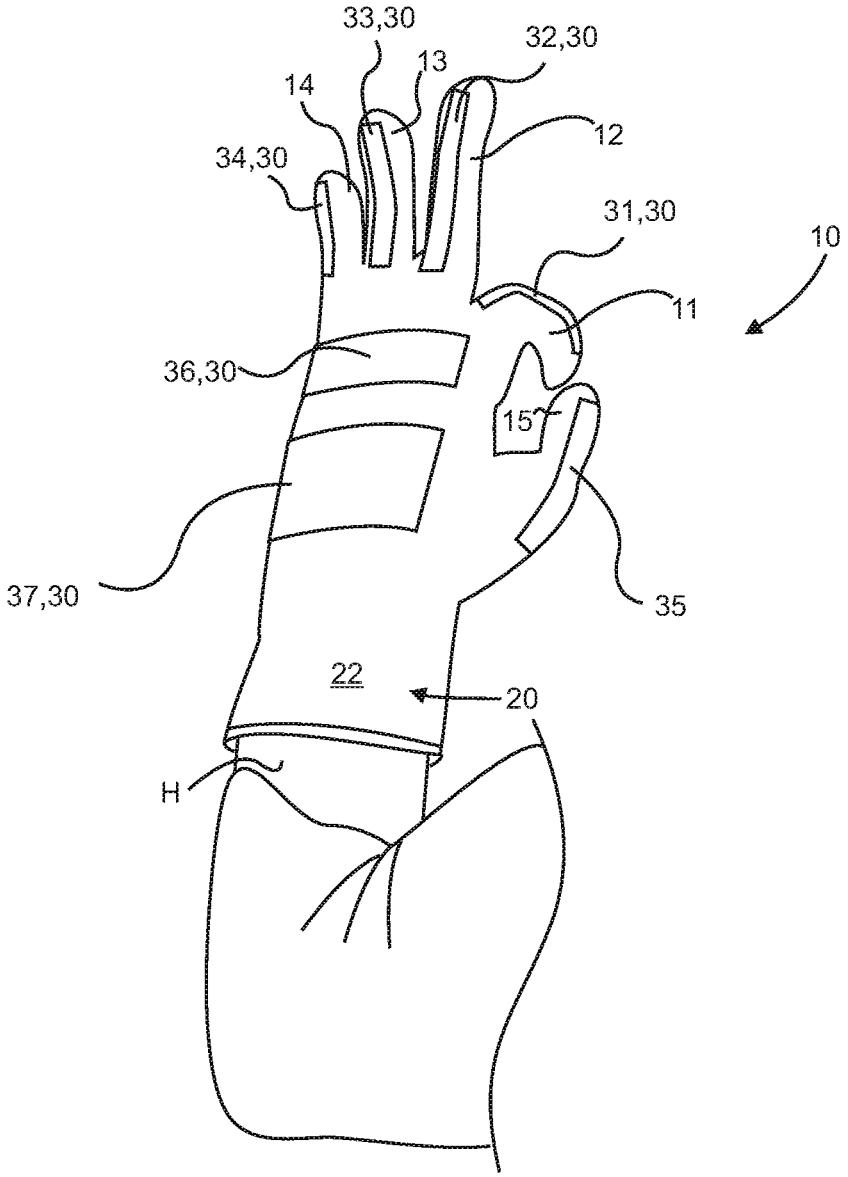
FIG. 4 is a perspective view of the apparatus for enhancing hand signal communication at night according to select embodiments of the instant disclosure, showing hand signal for "I understand" (OK)

Referring now to FIG. 4, by way of example, and not limitation, there is illustrated an example embodiment of an apparatus for enhancing hand signal communication at night, such as signaling glove 10 showing hand signal for 'I understand (OK)'. Preferably signaling glove 10 via user's hand has three fingers sections 12-14, including middle finger section 12, ring finger section 13, and pinky finger section 14 are all spread apart and index finger section 11 and thumb section 15 are in fingertip contact to form signaling glove 10. In this position signaling glove 10 presents or displays back side 22 of glove body 20 to other users in the rear or behind signaling glove 10 whereby other users may visualize patterns of plurality of elongated pieces or strip sections 32, 33, 34 affixed to or mounted thereon each of backside 22 of finger sections 12-14 spread apart, elongated pieces or strip section 31 and strip sections 35 forming an 'O' thereon each of backside 22 of finger section 11 and 15, and patterns 36 and 37, affixed to or mounted thereon backside 22 of glove body 20, together indicating 'OK' and nonverbal translation 'I understand (OK)'.

It is recognized herein that signaling glove 10 may be utilized to signal a variety of signals know to users and viewers, such as nighttime hand signal system that can be used by forward personnel in a police or military unit to provide a variety of hand signal communication to others as well as identify friend verse enemy personnel using a night vision optic system.

Figure 5:
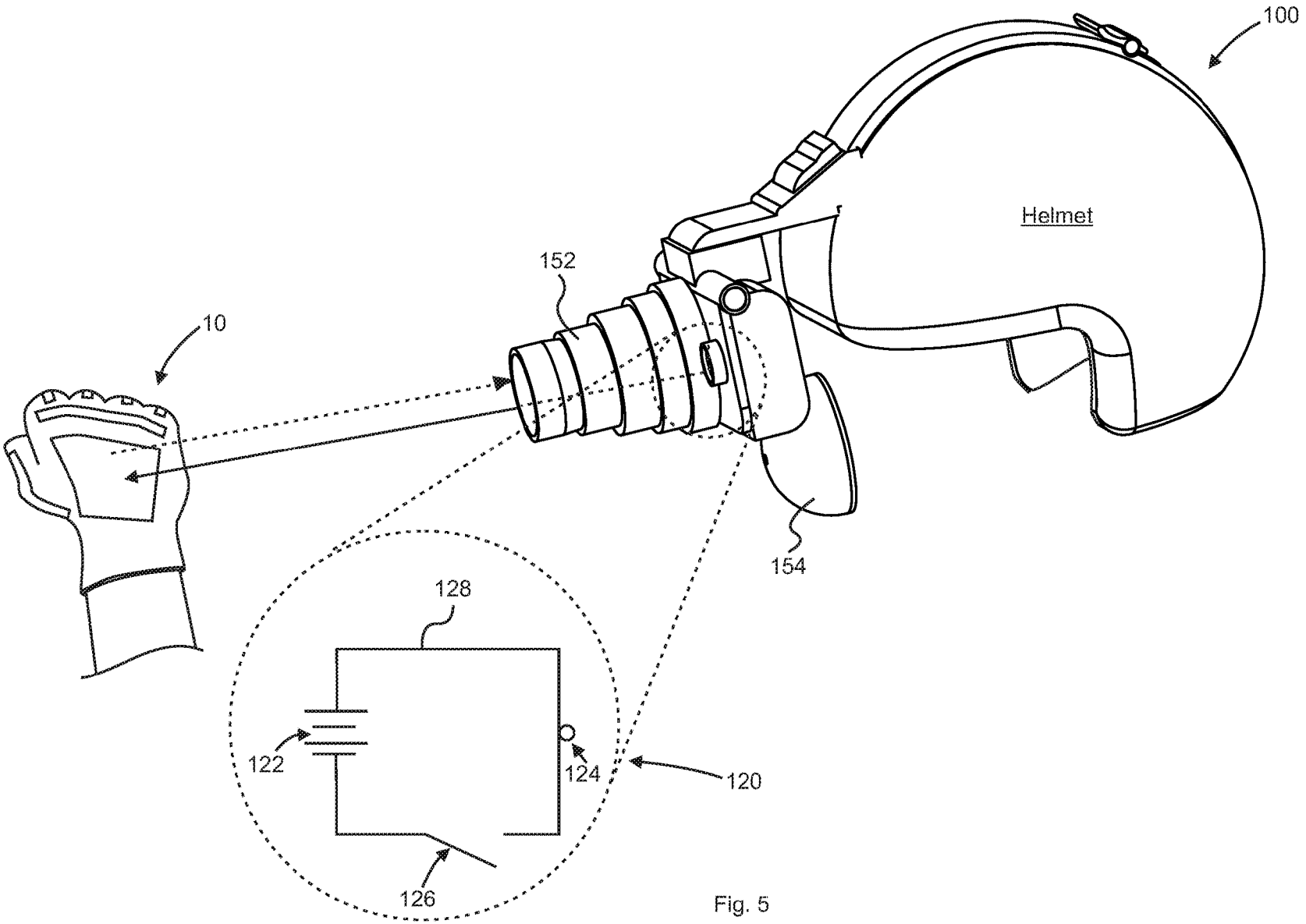
FIG. 5 is a front view of the system for enhancing hand signal communication at night in use with night goggles, according to select embodiments of the instant disclosure.

Referring now to FIG. 5, by way of example, and not limitation, there is illustrated an example embodiment of a system for enhancing hand signal communication at night 100. System for enhancing hand signal communication at night 100 may include, signaling glove 10, infrared (IR) light source 120, and night vision optical viewer 150 attached thereto helmet H. Moreover, infrared (IR) light source 120 may include a power supply, such as battery 122, infrared light element 124, switch 126 all in electrical communication via wires 128 to form infrared (IR) light source 120. It is contemplated herein that infrared (IR) light source 120 may be a subsystem of night vision optical viewer 150. Furthermore, optics and optical infrared (IR) light sensor 152 may include optics and optical infrared (IR) light sensor 152 and a viewer, such as display 154 to display infrared (IR) light content captured by optics and optical infrared (IR) light sensor 152. In use, (IR) light source 120 is pointed or directed at a viewing area, such toward signaling glove 10, (IR) light travels from (IR) light source 120 to signaling glove 10 and bounces back off infrared (IR) reflective material 30 to optics and optical infrared (IR) light sensor 152 where night vision optical viewer 150 displays viewing area, such as current hand configuration of signaling glove 10 with finger sections 11-14, including index finger section 11, middle finger section 12, ring finger section 13, and pinky finger section 14, and thumb section 15 shown with infrared (IR) reflective material 30 of a plurality of elongated pieces or strip sections 31, 32, 33, 34, 35, 36, 37 reflecting (IR) light from (IR) light source 120 making signaling glove 10 and its nonverbal hand signal communication visible to viewer to view (rear personnel) via optics and optical infrared (IR) light sensor 152 and a viewer, such as display 154.

It is contemplated herein that system for enhancing hand signal communication at night 100 may enable a person observing under nighttime conditions to determine if a person is a friendly force member by the presence of a pattern of reflections of (IR) light source 120 from plurality of elongated pieces or strip sections 31, 32, 33, 34, 35, 36, 37, especially pattern of strip sections 36 and 37 visible to viewer via optics and optical infrared (IR) light sensor 152 and a viewer, such as display 154.

Figure 6:
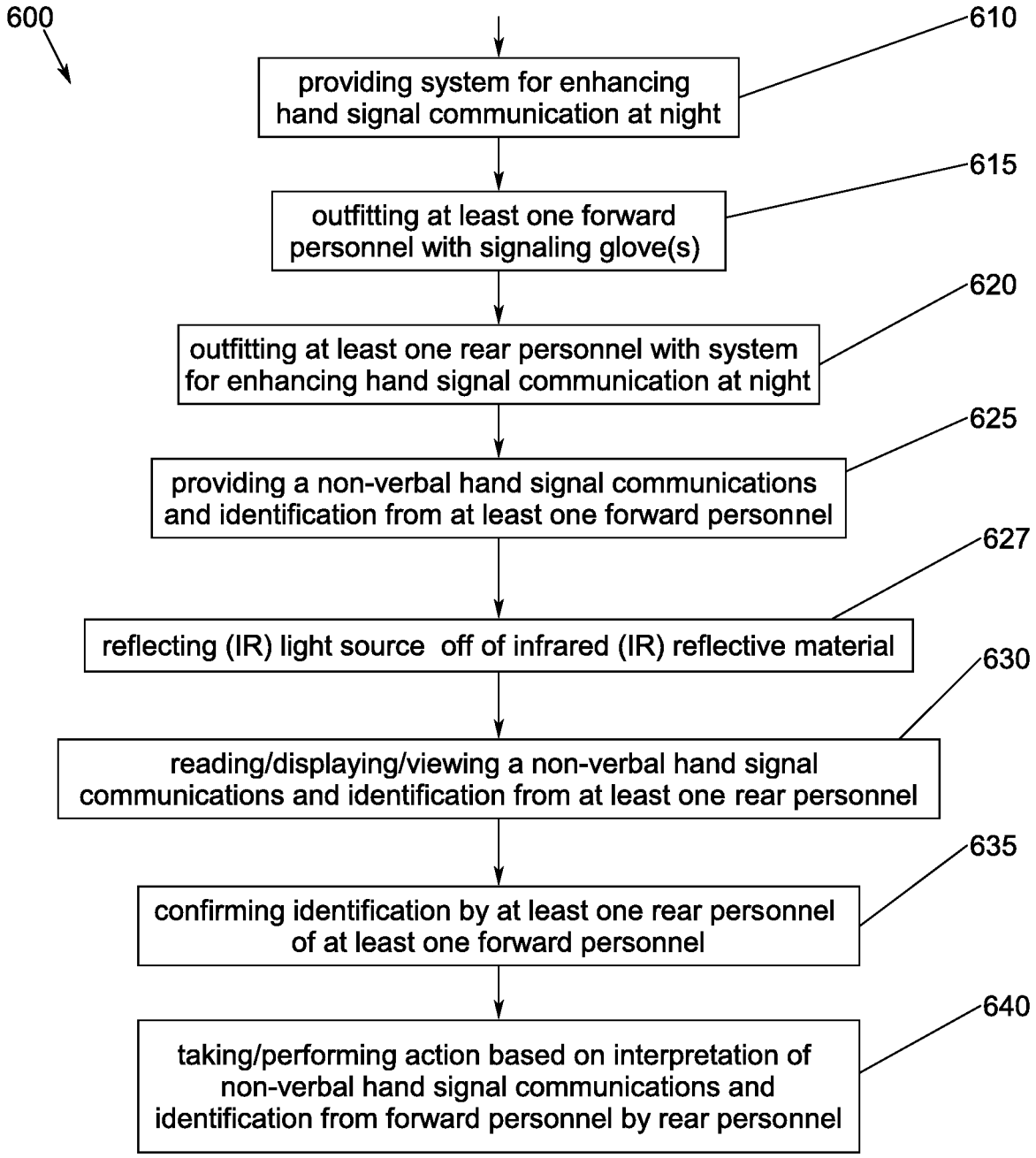
FIG. 6 is a flow diagram of a method of using the system for enhancing hand signal communication at night according to select embodiments of the instant disclosure.

Referring now to FIG. 6, there is illustrated a flow diagram 600 of a method of nonverbal hand signal communication at night. In block or step 610, providing system for enhancing nonverbal hand signal communication 100 as set forth in any of the embodiments discussed herein, and/or shown in FIGS. 1-5.

In block or step 615 outfitting at least one forward personnel with signaling glove(s) 10, such as police or military unit. In block or step 620 outfitting at least one rear personnel with system for enhancing hand signal communication at night 100, such as police or military unit to enable personnel to interpret a variety of nonverbal hand signal communications as well as identify friend verse enemy personnel via night vision goggles.

In block or step 625 providing or displaying a nonverbal hand signal communication and identification from at least one forward personnel, such as police or military unit, to others personnel, such as other police or military personnel in the unit, via signaling glove(s) 10.

In block or step 627 reflecting (IR) light source 120 off of infrared (IR) reflective material 30, such as plurality of elongated pieces or strip sections 31, 32, 33, 34, 35, 36, 37 affixed to backside 22 of signaling glove 10.

In block or step 630 reading/displaying/viewing (read/display/view) a nonverbal hand signal communications and identification from at least one rear personnel, such as police or military unit, by rear personnel, such as other police or military personnel in the unit.

In block or step 635 confirming identification (an identity) by at least one rear personnel of at least one forward personnel, such as police or military unit, by rear personnel, such as other police or military personnel in the unit to establish identify as friendly personnel verse enemy personnel by reading pattern of strip sections 36 and 37 of forward personnel.

In block or step 640 taking/takes/performing action (rear personnel) based on interpretation of nonverbal hand signal communications and identification from forward personnel by rear personnel, such as other police or military personnel in the unit.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

It is understood herein that various changes in the material used, shape, size, arrangement of parts, and parts without departing from the spirit of the scope of the claims herein.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Moreover, the present disclosure has been described in detail, it should be understood that various changes, substitutions and alterations can be made thereto without departing from the spirit and scope of the disclosure as defined by the appended claims. Accordingly, the present disclosure is not limited to the specific embodiments illustrated herein but is limited only by the following claims.

The invention claimed is:

1. A nighttime hand signal communication system for a user's hand, said system comprising:

a glove having a backside and adapted to be worn on the user's hand to communicate the hand signal communication, said backside having one or more infrared reflective material patterns affixed to said backside of said glove;

an infrared light source positioned behind said glove; and a night vision optical viewer to view said infrared light source reflected off said infrared reflective material patterns affixed to said backside of said glove.

2. The system of claim 1, wherein a forward person displays the hand signal communication via said infrared reflective material patterns affixed to said backside of said glove.

3. The system of claim 2, wherein a rear personnel views said infrared light source reflected off said infrared reflective material patterns affixed to said backside of said glove.

4. The system of claim 3, wherein said rear personnel reads the hand signal communication via said night vision optical viewer.

5. The system of claim 4, wherein said rear personnel identifies said forward person as friendly forces.

6. The system of claim 5, wherein said rear personnel takes action based on the hand signal communication.

7. The system of claim 1, wherein said glove having finger sections and thumb section.

8. The system of claim 7, wherein said backside of each said finger sections and said thumb section having an elongated strip section of said infrared reflective material patterns mounted thereon to enable the hand signal communication.

9. The system of claim 4, wherein said glove further comprises a glove body.

10. The system of claim 9, wherein said backside of said glove body having said infrared reflective material patterns mounted thereon to enable identification of said forward person.

11. A method of nonverbal hand signal communication at night, said method comprising the steps of:

providing a glove having a backside, finger sections, a thumb section and adapted to be worn on a user's hand, said backside having one or more infrared reflective material patterns affixed to said backside of said glove, an infrared light source positioned behind said glove, a night vision optical viewer to view said infrared light source reflected off said infrared reflective material patterns affixed to said backside of said glove;

outfitting at least one forward personnel with said signaling glove; and outfitting at least one rear personnel with night vision optical viewer.

12. The method of claim 11, further comprising the step of displaying said backside of said glove with said finger sections and said thumb sections positioned to display said one or more infrared reflective material patterns, the nonverbal hand signal communication.

13. The method of claim 12, further comprising the step of reflecting said infrared light source off said one or more infrared reflective material patterns affixed to said backside of said glove.

14. The method of claim 13, further comprising the step of reading said one or more infrared reflective material patterns, the nonverbal hand signal communication via said night vision optical viewer.

15. The method of claim 14, further comprising the step of displaying said one or more infrared reflective material patterns, the nonverbal hand signal communication via said night vision optical viewer.

16. The method of claim 15, further comprising the step of viewing said one or more infrared reflective material patterns, the nonverbal hand signal communication via said night vision optical viewer.

17. The method of claim 16, further comprising the step of confirming an identity of said user based on said infrared reflective material patterns affixed to said backside of said glove.

18. The method of claim 17, further comprising the step of performing an action by a rear personnel based on said infrared reflective material patterns affixed to said backside of said glove of a forward personnel.

* * * * *